US011506054B2

(12) United States Patent
Brown et al.

(10) Patent No.: US 11,506,054 B2
(45) Date of Patent: Nov. 22, 2022

(54) METHOD FOR MOUNTING A ROLL OF PROTECTIVE MESH MATERIAL TO AN UNDERGROUND ROCK DRILLING MACHINE, A METHOD FOR ATTACHING PROTECTIVE MESH MATERIAL TO A ROCK SURFACE AND A MOUNTING DEVICE

(71) Applicant: Geobrugg AG, Romanshorn (CH)

(72) Inventors: Shane Brown, Glen Forrest (AU); Roland Bucher, Mosman Park (AU)

(73) Assignee: Geobrugg AG, Romanshorn (CH)

( * ) Notice: Subject to any disclaimer, the term of this patent is extended or adjusted under 35 U.S.C. 154(b) by 0 days.

(21) Appl. No.: 17/430,305

(22) PCT Filed: Feb. 13, 2020

(86) PCT No.: PCT/EP2020/053763
§ 371 (c)(1),
(2) Date: Aug. 11, 2021

(87) PCT Pub. No.: WO2020/165346
PCT Pub. Date: Aug. 20, 2020

(65) Prior Publication Data

US 2022/0162940 A1 May 26, 2022

(30) Foreign Application Priority Data

Feb. 13, 2019 (AU) ..... 2019200996

(51) Int. Cl.
*E21D 11/00* (2006.01)
*E21D 11/40* (2006.01)
(Continued)

(52) U.S. Cl.
CPC ..... *E21D 11/006* (2013.01); *E21B 7/025* (2013.01); *E21B 7/027* (2013.01); *E21D 11/152* (2013.01); *E21D 11/406* (2016.01); *E21B 7/046* (2013.01)

(58) Field of Classification Search
CPC ... E21D 11/006; E21D 11/406; E21D 11/152; E21D 11/40; E21B 7/025; E21B 7/027; E21B 7/046; E21C 35/04
See application file for complete search history.

(56) References Cited

U.S. PATENT DOCUMENTS 4,122,682 A 10/1978 Groetschel
5,816,750 A * 10/1998 Steffenino ..... E21D 11/006 405/291
(Continued)

FOREIGN PATENT DOCUMENTS

CN 101915110 A 12/2010
DE 2836659 A1 3/1980
(Continued)

OTHER PUBLICATIONS

International Search Report of the International Searching Authority dated Jun. 10, 2020 for the corresponding international application No. PCT/EP2020/053763.
(Continued)

*Primary Examiner* — Carib A Oquendo
(74) *Attorney, Agent, or Firm* — Posz Law Group, PLC

(57) ABSTRACT

A method for mounting a roll of protective mesh material to an underground rock drilling machine comprising at least one drilling boom. The method comprises at least the following steps: inserting a first end of a first bar from a first lateral side of the roll of protective mesh material into a center of the roll of protective mesh material, fastening the first bar directly or indirectly to the drilling boom, inserting a first end of a second bar from a second lateral side of the
(Continued)

Figure 1:
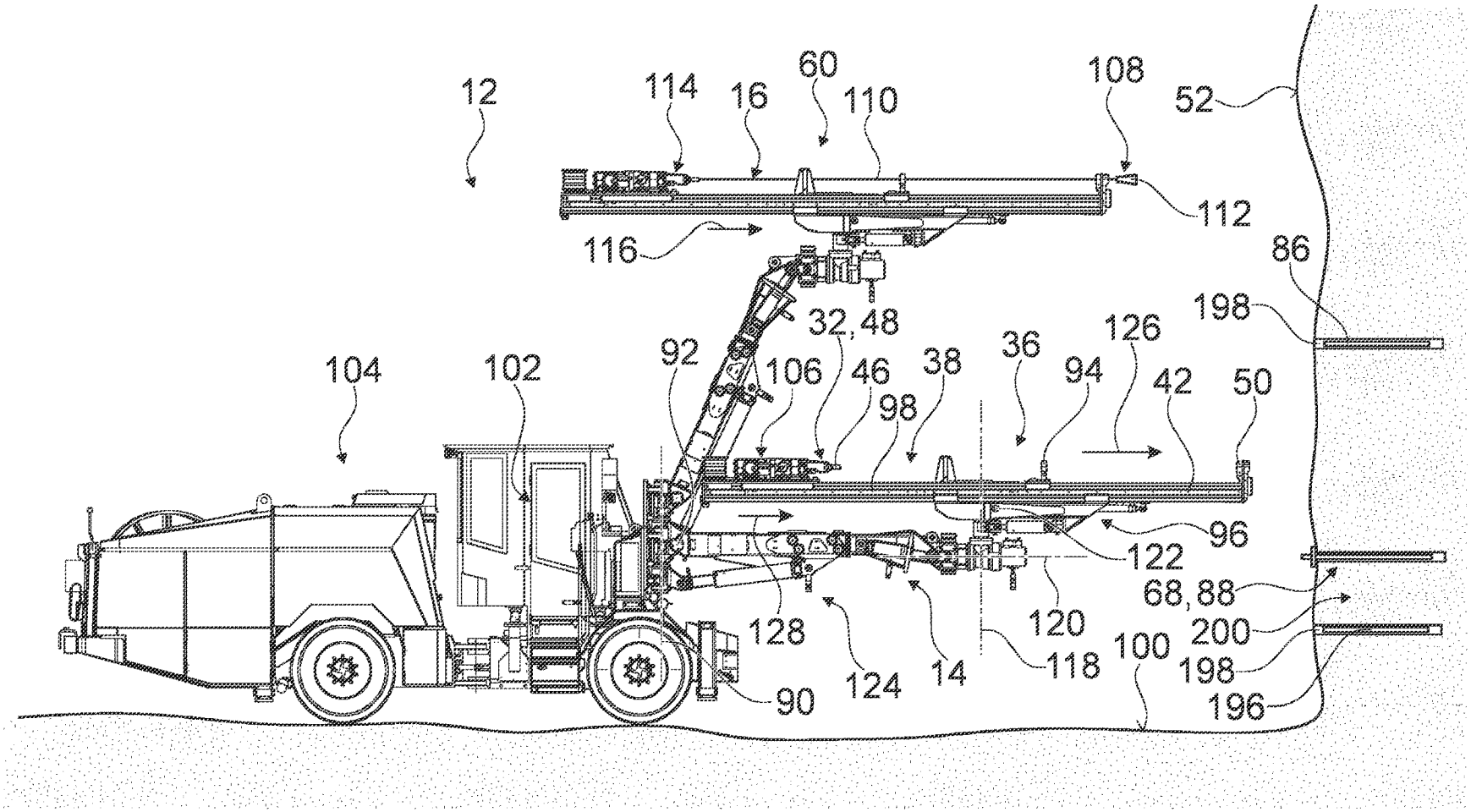

roll of protective mesh material opposite the first lateral side into the center of the roll of protective mesh material, fastening the second bar directly or indirectly to the drilling boom in a location that is spaced apart from the first bar, securing the roll of protective mesh material against autonomous unrolling.

18 Claims, 6 Drawing Sheets

(51) Int. Cl.

| | |
|---|---|
| ***E21B 7/02*** | (2006.01) |
| ***E21D 11/15*** | (2006.01) |
| *E21B 7/04* | (2006.01) |

(56) References Cited

U.S. PATENT DOCUMENTS

| | | | | |
|---|---|---|---|---|
| 8,137,033 | B1 | 3/2012 | Hinshaw et al. | |
| 9,194,231 | B2 * | 11/2015 | Burgess | E21D 5/00 |
| 10,851,651 | B2 * | 12/2020 | Bischof | E21D 11/152 |
| 2011/0150575 | A1 * | 6/2011 | Brown | E21D 11/152 405/150.1 |
| 2018/0216406 | A1 | 8/2018 | Van Dyk | |
| 2021/0222553 | A1 * | 7/2021 | Zhang | E21D 11/406 |

FOREIGN PATENT DOCUMENTS

| | | | |
|---|---|---|---|
| EP | 1298283 | A1 | 4/2003 |
| WO | 2017/144090 | A1 | 8/2017 |

OTHER PUBLICATIONS

Australian Examination Report dated Oct. 25, 2019, issued in corresponding Australian Patent Application No. 2019200996.

Coates et al., "Fully mechanised installation of high-tensile chain-link mesh for surface support in tunnels", Australian Centre for Geomechanics, pp. 165-172, 2009.

Kalejta et al., "Innovative Technology System for Ground Support with a Fast, Safe and Fully Mechanized Way of Installing Wire Mesh", OneMine, pp. 1-11 , 2013.

Chilean Office Action dated Jun. 8, 2022 issued in corresponding CL Patent Application No. 1994-2021 (and English machine translation).

* cited by examiner

METHOD FOR MOUNTING A ROLL OF PROTECTIVE MESH MATERIAL TO AN UNDERGROUND ROCK DRILLING MACHINE, A METHOD FOR ATTACHING PROTECTIVE MESH MATERIAL TO A ROCK SURFACE AND A MOUNTING DEVICE

CROSS REFERENCE TO RELATED APPLICATIONS

This application is a U.S. national stage application of PCT/EP2020/053763 filed on Feb. 13, 2020, which is based on Australian Patent Application No. 2019200996 filed on Feb. 13, 2019, the contents of which are incorporated herein by reference.

STATE OF THE ART

The invention relates to a method for mounting a roll of protective mesh material to an underground rock drilling machine, to a method for attaching protective mesh material to a rock surface and to a mounting device.

From the state of the art, various methods for automated or semi-automated installation of protective meshes in underground mines are known. However, these methods rely on separate storage devices for the protective mesh material, for example specifically designed holding arms for rolls of protective material, the preparation and application of which may be time-consuming.

The objective of the invention is in particular to provide a method with advantageous characteristics regarding a provision of protective mesh material for an installation of the protective mesh material in an underground mine. The objective is achieved, according to the invention, by the features of the independent patent claims while advantageous implementations and further developments of the invention may be gathered from the subordinate claims.

ADVANTAGES OF THE INVENTION

The invention proceeds from a method for mounting a roll of protective mesh material to an underground rock drilling machine, in particular a drilling jumbo, comprising at least one boom, preferably at least two booms, in particular one of which could be a drilling boom.

It is proposed that the method comprises at least the following steps:

- inserting a first end of a first bar from a first lateral side of the roll of protective mesh material into a center of the roll of protective mesh material
- fastening the first bar directly or indirectly to the boom
- inserting a first end of a second bar from a second lateral side of the roll of protective mesh material opposite the first lateral side into the center of the roll of protective mesh material
- fastening the second bar directly or indirectly to the boom in a location that is spaced apart from the first bar
- securing the roll of protective mesh material against autonomous unrolling.

In particular, by this method advantageous characteristics regarding a provision of protective mesh material for an installation of the protective mesh material in an underground mine can be achieved. Advantageously, a simple and therefore time-saving mounting method for rolls of protective mesh material, in order to ready the rolls of protective material for an installation to a mine wall or a mine ceiling, can be achieved. Furthermore, the method allows a simple and quick substitution of rolls of protective mesh material. Additionally, the method provides an advantageously low level of complexity and is easy to learn and easy to perform by the operating personnel. The method further advantageously enables a use of an already on-site underground rock drilling machine for the task of the installation of protective mesh material to the surfaces of the mine, hence a provision of additional machinery for unrolling the rolls of protective mesh material is rendered unnecessary.

The protective mesh material in particular is implemented as a wire mesh, preferably a metal wire mesh made at least partly of high-tensile steel. Preferably the wire mesh is formed from interconnected wires being shaped as flat helices, forming a rectangularly meshed structure. However, the protective mesh material can also be implemented as other mesh material, for example ring meshes, hexagonal meshes or else. Additionally, or alternatively, the protective mesh material could be implemented as metal, non-metal or mixed material protective sheets or protective mats. In particular, the underground rock drilling machine is implemented as a drilling jumbo or a drilling rig, which in particular is deployed for drilling and blasting operations at a mine face. The boom in particular is implemented as a movable arm of the underground rock drilling machine. In particular, the boom is implemented as a drilling boom and/or is configured to hold, to centralize and/or to operate drilling equipment like a drill rod. Advantageously the underground rock drilling machine is configured to drill holes with a depth of at least several meters using the drilling boom. In particular, the boom comprises an actuation unit, which is implemented to control, drive and steer a movement of the boom in at least two, preferably three, dimensions.

In particular, the first bar is inserted into the first lateral side of a roll of protective mesh material by operating personnel of the underground rock drilling machine either manually or with the help of the actuation unit of the boom. The roll of protective mesh material is rolled up in a way that a center of the roll is free of protective mesh material. The center of the roll of protective mesh material has a width of at least 50 mm, preferably of at least 100 mm and advantageously of at least 150 mm. It is conceivable that the center of the roll of protective mesh material comprises a kind of hollow or at least partially hollow pipe element, which the protective mesh material is wrapped around. Openings of the hollow or at least partially hollow pipe element are particularly arranged at the lateral sides of the roll of protective mesh material. When inserting the first end of the first bar into the first lateral side of the roll of protective mesh material preferably at least 5%, preferably at least 10% of the full length of the bar is inserted. In particular at least a length of 100 mm, preferably at least of 200 mm and advantageously at least of 400 mm of the first bar is inserted into the center of the roll of protective mesh material, particularly into the pipe element.

If a bar is "fastened directly" to the boom, in particular at least a part of the bar is in direct contact with the boom. For example, if the bar comprises a feed through element which is adapted to receive a part of the boom, for example a shank of the boom, which in particular is normally used to mount a drilling equipment, the bar and the boom are connected directly. If the bar is "fastened indirectly" to the boom, in particular at least one intermediate piece is used in between the boom and the bar. However, both, a directly and an indirectly fastened bar in particular is configured to instantaneously follow every movement of the boom. Preferably, the bar is implemented in one piece. Alternatively, it is conceivable that the bar itself comprises several separate pieces, which preferably are firmly connected with each other. Each bar comprises at least a first and at least a second end. In particular, the first end and the second end of a bar are part of a single piece bar, however the first end and the second end could also be located on different pieces of a multi-part bar. In particular, the second bar is separate from the first bar. The bar preferably has at least section wise a round or elliptical profile for an easy rotation of the roll of protective material, however alternatively the bar could also have a polygonal, for example square, or partly round and partly polygonal cross section.

In particular, when inserted into the roll of protective mesh material, the first end of the first bar and the first end of the second bar point towards each other. In particular, the second bar is inserted into the second lateral side of a roll of protective mesh material by operating personnel of the underground rock drilling machine either manually or with the help of the actuation unit of the boom. Preferably the bars are fastened to the boom at locations close to opposite ends of the boom, in particular in a direction parallel to a main extension direction of the boom. By a "main extension direction" of an object herein in particular a direction is to be understood which extends in parallel to a largest edge of a smallest imaginary rectangular cuboid which just still encloses the object. The meaning of an "autonomous unrolling" of a roll herein is in particular to be understood as an unrolling of the roll, which is induced to an overwhelming extent by gravitational forces acting on the roll and/or on the protective mesh material, in particular on an already unrolled part of the protective mesh material, and/or by acceleration forces caused by a movement of the boom.

Furthermore, it is suggested that for securing the roll of protective mesh material against autonomous unrolling, the roll of protective mesh material is tensioned by applying a pressure to at least one of the lateral sides of the roll of protective mesh material, preferably to both lateral sides of the roll of protective mesh material. Thus, advantageous characteristics regarding a provision of protective mesh material for an installation of the protective mesh material in an underground mine can be achieved. In particular, an unwanted unrolling of protective mesh material, for example during movement of the boom the roll of protective mesh material is attached to, can advantageously be avoided. In particular, if a tensioning force is applied only to one side, the protective mesh of the roll of protective mesh material is pressed against the boom, against one of the bars or against another fixed element, increasing an internal friction in the protective mesh material and/or a friction of the protective mesh material with the element it is pressed against. In case pressure is applied from both sides of the roll of protective mesh material, the roll of protective mesh material is in particular clamped in a plier-like fashion between two pressure applying elements.

Additionally, it is suggested that the roll of protective mesh material is secured against autonomous unrolling by a movement mechanism of the underground rock drilling machine, in particular of the boom, which is normally applied for moving at least part of a drilling equipment, for example for moving a drill. Thus, a level of complexity can advantageously be kept low. Furthermore, an easy operability can be advantageously achieved, in particular because operating personnel is only required to control already familiar equipment like the drilling jumbo. Additionally, already available equipment can advantageously be used for additional purposes, yielding a high efficiency of the process. In particular, the movement mechanism is implemented as the drive mechanism, which normally is used to drive a drill rod into a rock face during a drilling operation of the underground rock drilling machine. This drive mechanism is advantageously used to move at least one of the bars in a direction of the other bar, in order to tension the roll of protective mesh material.

Moreover, it is suggested that in order to secure the roll of protective mesh material by tensioning the roll of protective mesh material, the movement mechanism is actuated in a direction that is at least substantially parallel to an unrolling axis of the roll of protective mesh material. Thus, an even tensioning can advantageously be achieved. Advantageously, transverse forces, potentially leading to a jamming of the roll of protective mesh material or to an inappropriate unrolling of the protective mesh material can be kept at a minimum. By "at least substantially parallel" here in particular an orientation of a direction with respect to a reference direction, in particular in a plane, is to be understood, wherein the direction deviates from the reference direction in particular by less than 8°, advantageously by less than 5° and especially advantageously by less than 2°.

In addition, it is suggested that the roll of protective mesh material is secured by applying a, in particular hydraulic and/or pneumatic, feed pressure of a feed of a drifter drill of the underground rock drilling machine to tension the roll of protective mesh material. Thus, a level of complexity can advantageously be kept low. Furthermore, an easy operability can be advantageously achieved, in particular because operating personnel is only required to control already familiar equipment like the drilling jumbo. Additionally, already available equipment can advantageously be used for additional purposes, yielding a high efficiency of the process. By a "drifter drill", in particular a hydraulic or pneumatic rock drill is to be understood, which preferably is mounted on a, in particular rail-like, feed, which allows the drill or in this case the attachment point of at least one of the bars to travel in a linear direction that is at least substantially parallel to a main extension direction of the boom it is a part of.

When the movement mechanism, which in particular is normally used for moving at least part of the drilling equipment, in particular the feed of the drifter drill, is used for moving and/or pressing the first bar and the second bar towards each other, a simple and effective way for tensioning the roll of protective mesh material can advantageously be achieved. In particular, at least the first bar and/or at least the second bar is attached to a, in particular hydraulically or pneumatically, moveable section of the movement mechanism, for example the feed of the drifter drill.

It is further suggested, that when the boom is lifted and not tilted, the roll of protective mesh material which is mounted to the boom by the first bar and by the second bar is suspended on the left side of the boom or on the right side of the boom. Thus, an advantageous positioning of the roll of protective mesh material relative to a wall or ceiling surface with the boom can be achieved. Furthermore, a mounting procedure of the roll of protective mesh material to the boom can advantageously be facilitated. In particular, the boom is in a non-tilted state, when the feed of the drifter drill is in a horizontal level position. In particular, the roll of protective mesh material is not in contact with structural elements of the boom, when suspended on a side of the boom and/or when the boom is not tilted.

Moreover, it is suggested that in order to secure the roll of protective mesh material against autonomous unrolling, the roll of protective mesh material mounted to the boom is tilted in such a way that the protective mesh material of the roll of protective mesh material rests on a left side of the boom or on a right side of the boom. Thus, an unwanted autonomous unrolling of the roll of protective mesh material can advantageously be prevented. Advantageously, the roll of protective mesh material can be, in particular further, secured without a need for additional components. Advantageously, the gravitational force can be exploited for securing the roll of protective mesh material. Furthermore, a level of rotatability of the roll of protective mesh material can advantageously be adjusted by modifying a tilting angle of the boom. In particular, when the tilting angle of the boom increases, an internal friction of the roll of protective mesh material and/or an external friction of the roll of protective mesh material with the boom increases accordingly, or vice versa. In particular, in order to secure the roll of protective mesh material against autonomous unrolling, the boom is tilted about a tilting axis, which extends at least substantially parallel to a main extension direction of the boom. The left side of the boom and/or the right side of the boom in particular are surfaces of structural elements of the boom, which in the non-tilted state of the boom are largely lying out of a horizontal plane. Preferably, the left side of the boom and/or the right side of the boom largely lie a vertical plane, when the boom is not tilted. In particular, when the roll of protective mesh material is mounted on the right side of the boom and is then lifted upwards by the boom without tilting it is largely freely suspending from the right side of the boom. In particular, when the roll of protective mesh material is hanging from the right side of the boom, the boom is tilted about the tilting axis in a counter-clockwise direction, preferably until at least a fraction of the weight of the roll of protective mesh material is supported by the right side of the boom, in particular in order to secure the roll of protective mesh material against autonomous unrolling. In particular, when the roll of protective mesh material is mounted on the left side of the boom and is then lifted upwards by the boom without tilting it is largely freely suspending from the left side of the boom. In particular, when the roll of protective mesh material is hanging from the left side of the boom, the boom is tilted about the tilting axis in a clockwise direction, preferably until at least a fraction of the weight of the roll of protective mesh material is supported by the left side of the boom, in particular in order to secure the roll of protective mesh material against autonomous unrolling.

When the first bar is fastened to a shank of the boom, in particular of the drifter drill of the boom, a simple and swift mounting method, which in particular is already familiar to the operating personnel can be achieved. Furthermore, the movement mechanism of the boom, which in particular is configured to influence the position of the shank relative to the rest of the boom, can advantageously be utilized for a manipulation of the position of the first bar. In particular, a section of the first bar is slipped over the shank in order to fasten the first bar to the shank. However, alternative fastening methods are conceivable.

When the second bar is fastened to a centralizer, in particular a boring centralizer, of the boom, in particular of the drifter drill of the boom, a simple and swift mounting method can be achieved. Advantageously, components which are readily available at a typical boom of an underground rock drilling machine can be utilized for fastening the second bar. Furthermore, by fastening the second bar to the centralizer, a good alignment of the roll of protective mesh material and the boom can be guaranteed, advantageously facilitating an alignment of the roll of protective mesh material with a tunnel surface. Additionally, by fastening the second bar to the centralizer, a play of the second bar can advantageously be kept low. Thus, the second bar can be advantageously kept in a straight position. The centralizer is in particular implemented as a boring centralizer, normally used to centralize a drill rod and/or a drill steel. It is conceivable that the boom has more than one centralizer. Preferably, the second bar is fastened to the centralizer, which is closest to an end of the boom. However, the second bar could also be fastened to another centralizer, for example a centralizer in the middle of the boom.

Furthermore, a method for attaching protective mesh material to a rock surface, in which the protective mesh material is mounted to a first boom, in particular a drilling boom, of an underground rock drilling machine, in particular a drilling jumbo, is suggested, wherein in a method step, the first boom with the rolled-up protective mesh material is moved towards the rock surface and is at least substantially aligned with the rock surface, wherein in a further method step a freely suspended end of the protective mesh material is pinned to the rock surface by a pinning device of a second boom of the underground rock drilling machine, wherein in another further method step the protective mesh material is unrolled by moving the first boom along the rock surface in an unrolling direction at least substantially perpendicularly to an unrolling axis of the rolled-up protective mesh material, and wherein in an additional further method step, the pinning device attaches the unrolled protective mesh material to the rock surface at specific distances along the unrolling direction. Thus, a simple and time-effective method for mounting the protective mesh material can advantageously be achieved. Advantageously, an underground rock drilling machine, for example a common drilling jumbo, which preferably is already on site for drilling and blasting, can be utilized in addition for the mounting of the protective mesh material to recently excavated sections of a mine. Furthermore, a high level of safety for the operating personnel can be achieved, since the complete mounting procedure can advantageously be controlled from a remote location. In particular, when the protective mesh material is intended to be attached to a tunnel wall, the roll of protective mesh material is attached to the side of the boom, which is further away from the tunnel wall the protective mesh material is to be attached to. In particular, the freely suspended end of the protective mesh material is then guided around the roll of protective mesh material and over the boom, in a way that it hangs from the side of the boom, which is closer to the tunnel wall. Thus, an easy and effective tensioning of the protective mesh material can be achieved, in particular during installation of the protective mesh material. However, it is also conceivable that the roll of protective mesh material is mounted to the side of the boom, which is facing the tunnel wall during the mounting procedure. The pinning device in particular is implemented as a rock anchor installation device, which in particular is configured to drill holes and/or to install rock anchors at the pre-drilled holes.

When the protective mesh material is additionally anchored to the rock surface by cohesively joining anchors, in particular by resin bolts, using the pinning device of the second boom, a high level of security can advantageously be achieved. A "cohesively joining anchor" in particular is to be understood as an anchor, which is at least partly held in position by a cohesive bonding process and/or a chemical bonding process, for example a gluing process, a resinifying process, a gumming process, a vulcanizing process, a carburizing process, a casting process, a grouting process and/or similar.

In addition, a mounting device is suggested, which is configured to mount a roll of protective mesh material to a boom, in particular a drilling boom, of an underground rock drilling machine, in particular a drilling jumbo, with at least a first bar and a second bar, wherein each bar comprises a section that is adapted to be inserted into a center of the roll of protective mesh material and to bear a weight of at least 100 kg, preferably of at least 125 kg, advantageously of at least 150 kg, favorably of at least 200 kg and especially favorably of at least 250 kg, when the bars are used to lift the roll of protective mesh material. In particular, by this device advantageous characteristics regarding a provision of protective mesh material for an installation of the protective mesh material in an underground mine can be achieved. Advantageously, a simple and therefore time-saving mounting device for rolls of protective mesh material, in order to ready the rolls of protective mesh material for an installation to a mine wall or a mine ceiling, can be achieved. Furthermore, the mounting device allows a simple and quick substitution of rolls of protective mesh material. Additionally, the mounting device provides an advantageously low level of complexity and is easy to learn and easy to perform by the operating personnel.

It is further suggested that at least one of the bars, preferably both bars, comprises at least one bend of at least 60°. Thus, a space saving mounting device can advantageously be achieved, which is particularly important in cramped spaces like underground mines. In particular, the total bending of 60° could be divided over several separable parts of the bar, but preferably the total bending of 60° is completely comprised by a single piece of the bar.

When at least the second bar comprises a total bending of more than 90°, in particular of more than 120°, preferably of at least 180°, a space saving mounting device can advantageously be achieved, which is particularly important in cramped spaces like underground mines. Furthermore, such a second bar can advantageously be used for a tensioning of the roll of protective mesh material, by applying a pressure from a lateral side of the roll of protective mesh material. In particular, the total bending of 90° could be divided over several separable parts of the second bar, but preferably the total bending of 90° is completely comprised by a single piece of the second bar. In particular, the bend of 90° is comprised in a single, continuously bent region of the second bar. Preferably, the second bar comprises a further continuously bent region with a bend of at least 90°, which in particular is separated from the other continuously bent region of the second bar by at least one straight section.

Additionally, at least the second bar comprises a second end, in particular a second end piece, that extends at least substantially parallel to the section of the second bar which is adapted to be inserted into a center of the roll of protective mesh material, and which in particular is separated from the section of the second bar which is adapted to be inserted into a center of the roll of protective mesh material at least by an intermediate, in particular straight, section. Thus, an insertion of the bar into the roll of protective mesh material and a fastening of the second bar to the boom, in particular by an insertion of the second bar into a centralizer opening of the centralizer of the boom, can advantageously be achieved by a single motion of the second bar. In this way, an easy, time-effective and space-saving installation device for the installation of the roll of protective mesh material to the boom can be achieved. Furthermore, an easy alignment of the roll of protective mesh material with respect to the main extension direction of the boom can advantageously be achieved. The second end of the second bar, in particular the second end piece of the second bar, is in particular adapted to be inserted into the centralizer opening of the centralizer of the boom.

When the second end of at least the second bar, in particular the second end piece of at least the second bar, and the section of the second bar which is adapted to be inserted into a center of the roll of protective mesh material point into at least substantially identical directions. Consequently, an insertion of the bar into the roll of protective mesh material and a fastening of the second bar to the boom, in particular by an insertion of the second bar into a centralizer opening of the centralizer of the boom, can advantageously be achieved by a single motion of the second bar. Furthermore, an exact and/or easy alignment of the roll of protective mesh material with respect to the main extension direction of the boom can advantageously be achieved. "Substantially identical directions" in particular are to be understood as directions which extend with a relative angle of less than 5°, preferably less than 3° and favorably less than 1°.

Furthermore, it is suggested that at least the second bar comprises a fastening unit, which is adapted to captively mount the second bar to the boom via a centralizer of the boom. Thus, a high level of operational security and/or a high level of safety for an operator can be achieved. Furthermore, by mounting the second bar to the centralizer of the boom, a precise and easy alignment of the roll of protective mesh material with respect to the boom can be advantageously achieved. By a "captive mounting" in particular a mounting is to be understood, which prevents an autonomous unfastening.

Moreover, it is suggested that at least the first bar has an L-shape, in particular a bend of approximately 90°. Such a first bar in particular provides advantageous characteristics regarding a mounting and a securing of a roll of protective mesh material to a boom. In particular, such a first bar can advantageously be used for a tensioning of the roll of protective mesh material, by applying a pressure from a lateral side of the roll of protective mesh material. An "L-shape" in particular is to be understood as a shape which basically resembles a capital Latin block letter "L", wherein in particular the 90° bend of the "L-shape" may be a sharp edge or a rounded corner.

In addition, it is suggested that at least the first bar comprises a fastening unit, which is adapted to mount the first bar to a shank of the boom, in particular of the drifter drill of the boom, by at least partially encompassing the shank. Thus, advantageous characteristics regarding the mounting of the roll of protective mesh material to the boom can be achieved. In particular, the movement mechanism of the boom, which is adapted to move the shank, can advantageously be used to manipulate, in particular tension, the roll of protective mesh material which is mounted to the boom by the bars. In particular, by encompassing the shank an advantageous alignment of the bar relative to the boom, in particular the shank of the boom can be achieved.

It is further suggested that the sections of the bars which are configured to be inserted into the center of the roll of protective mesh material have a total length of less than 40%, preferably less than 30%, of a maximal extension of the roll of protective mesh material, parallel to an unrolling axis of the roll of protective mesh material. Thus, an easy, time-effective and/or space-effective mounting of rolls of protective mesh material to the boom, particularly within the cramped space of an underground mine, can be achieved.

Advantageously, a total weight of the bars can be kept low, so that a single person of the operating personnel advantageously is able to lift the bars by hand and move them around in order to facilitate an installation. Furthermore, an alignment of the bars with the center of the roll of protective mesh material during installation can advantageously be facilitated.

When the mounting device comprises a third bar, which has an at least approximately straight shape and which is configured to be inserted into the center of the roll of protective mesh material in between the at least two bars, a sagging of the protective mesh material and/or the roll of protective mesh material, when lifted by the mounting device and when being suspended from a side of the boom can advantageously be reduced and/or avoided. Thereby, rolling characteristics of the roll of protective mesh material can advantageously be improved. In particular, the third bar fills the space within the center of the roll of protective mesh material which might exist between the sections of the bars which are adapted to be inserted into the center of the roll of the protective mesh material by a large extent, preferably completely. By the wording "approximately straight" a shape of an object is to be understood, of which a smallest imaginary rectangular cuboid which just still encloses the object completely fits within a hollow at the center of the roll of protective mesh material. Preferably, the third bar comprises a round and/or an elliptical profile.

Furthermore, it is suggested that at least one of the bars, in particular each of first bar, second bar and third bar, weighs less than 30 kg, in particular less than 20 kg, preferably less than 15 kg. Thus, a single person of the operating personnel advantageously is able to lift the bars by hand and move them around in order to facilitate an installation.

The method for mounting a roll of protective mesh material to an underground rock drilling machine according to the invention, the method for attaching protective mesh material to a rock surface according to the invention and the mounting device according to the invention are herein not to be restricted to the applications and implementation forms described above. In particular, to fulfill a functionality herein described, the method for mounting a roll of protective mesh material to an underground rock drilling machine according to the invention, the method for attaching protective mesh material to a rock surface according to the invention and the mounting device according to the invention may comprise a number of respective elements and/or structural components and/or units and/or method steps that differ/s from a number herein mentioned.

DRAWINGS

Further advantages will become apparent from the following description of the drawings. In the drawings, one exemplary embodiment of the invention is depicted. The drawings, the description and the claims contain a plurality of features in combination. Someone skilled in the art will purposefully also consider the features separately and will find further expedient combinations.

Figure 2:
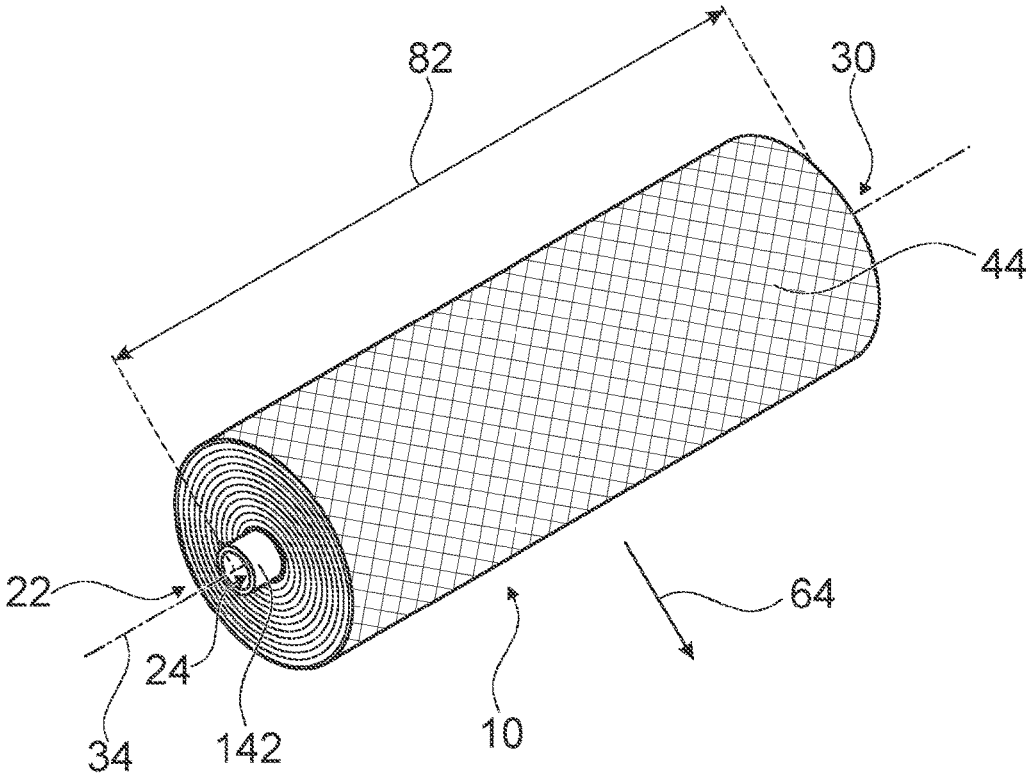
Figure 3:
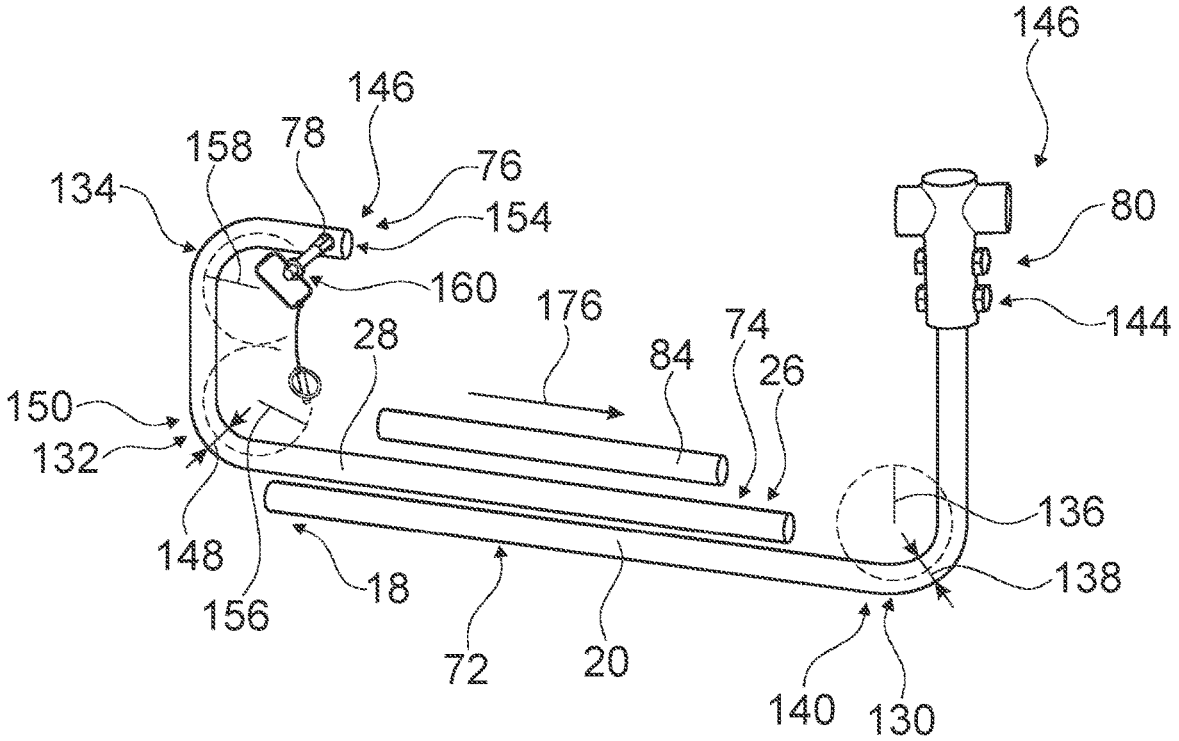
Figure 4:
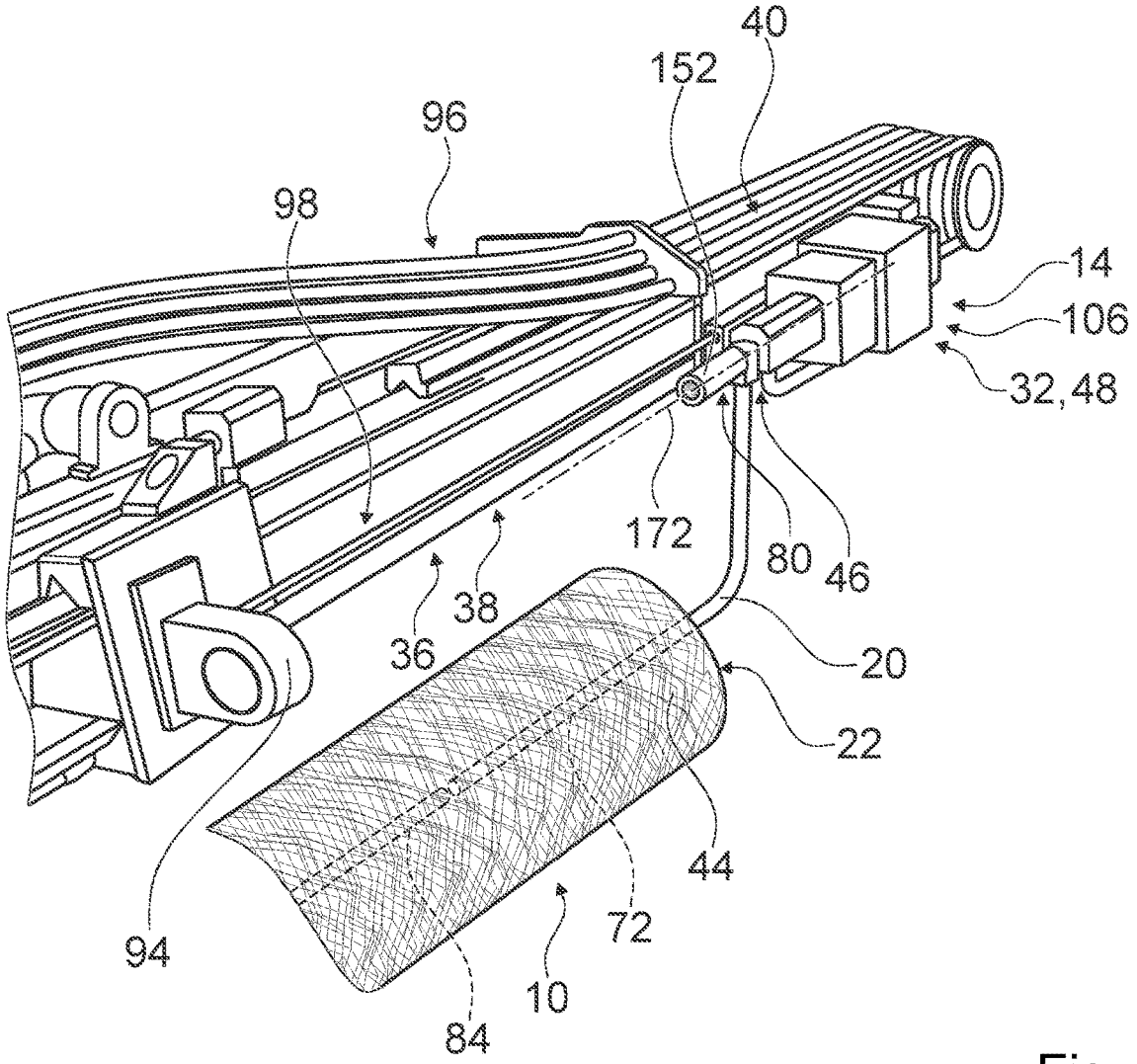
Figure 5:
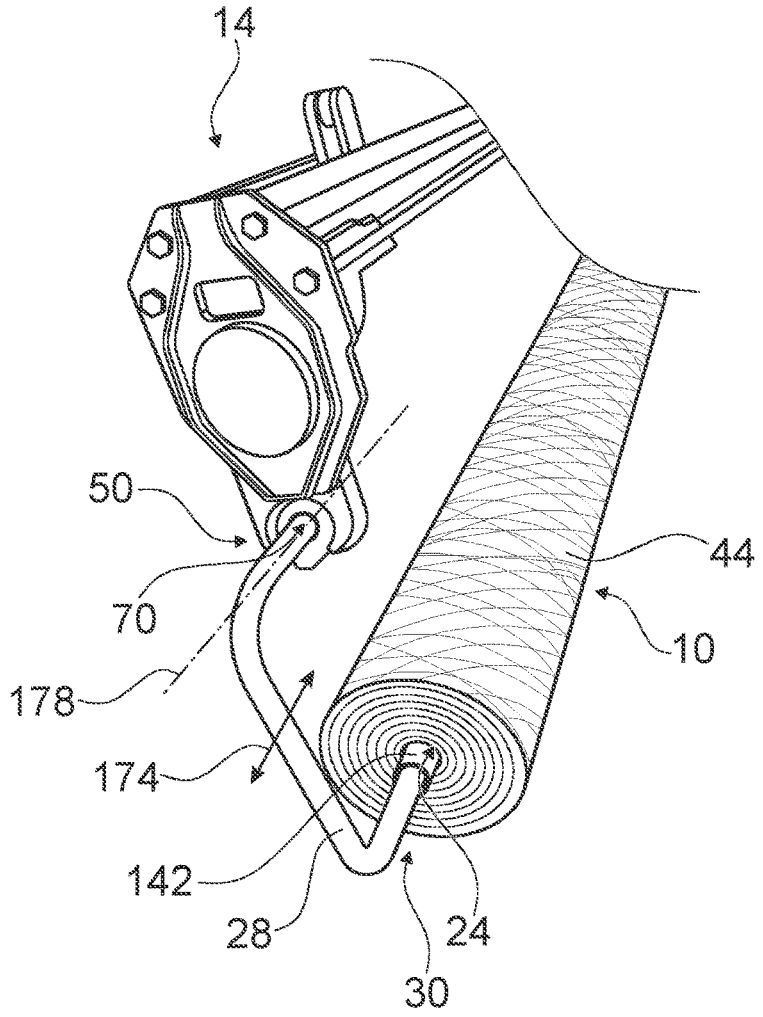
Figure 6:
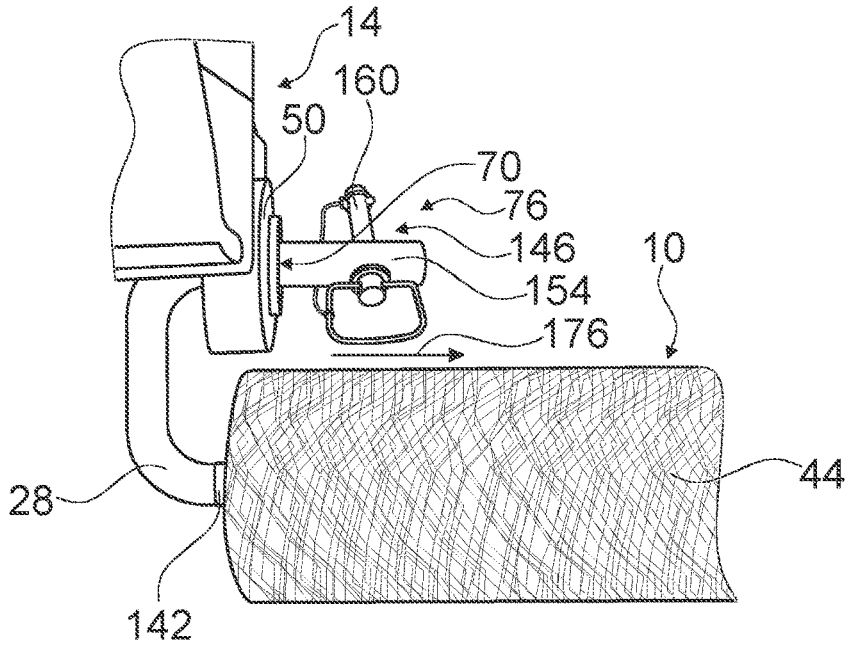
Figure 7:
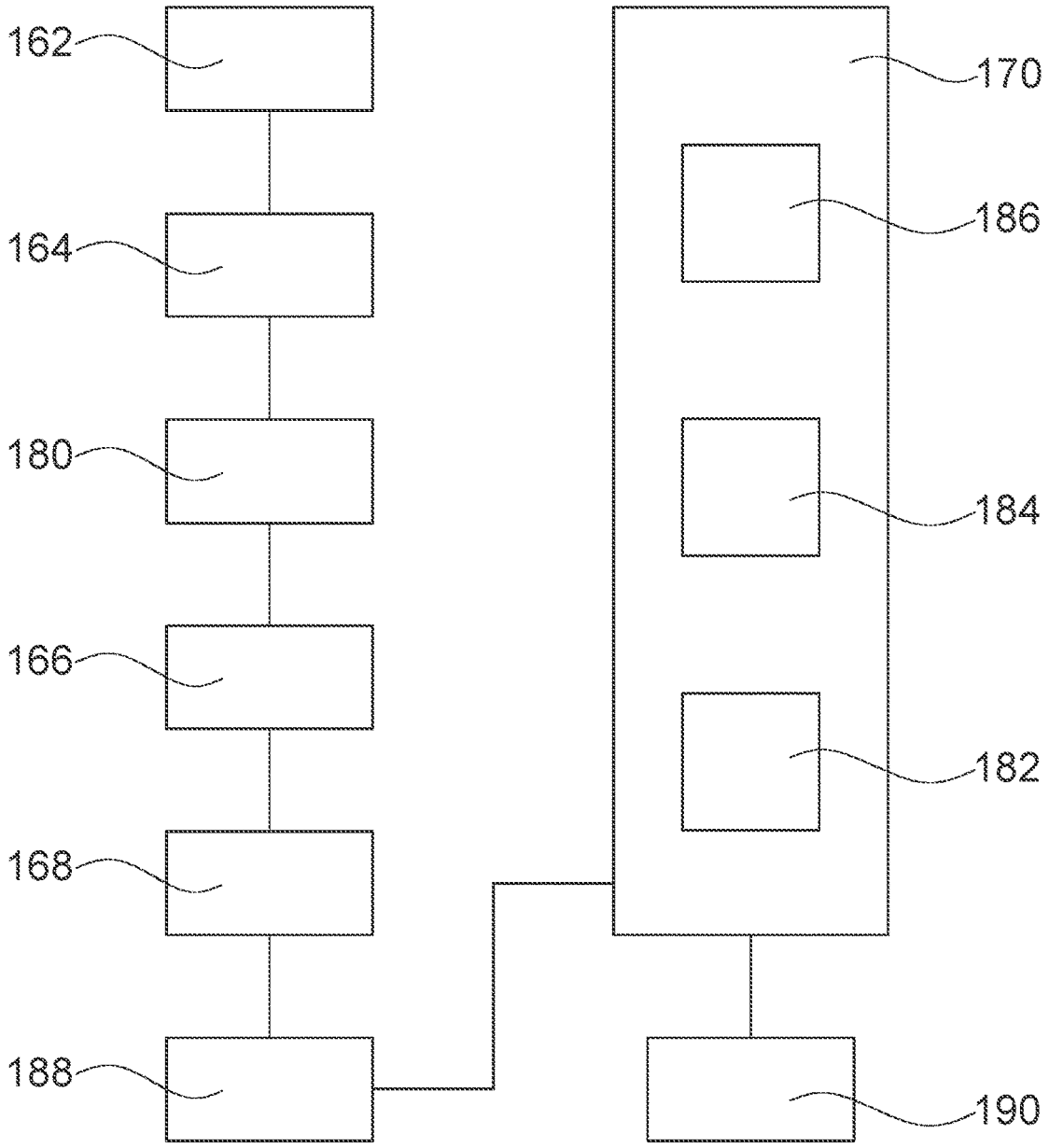
Figure 8:
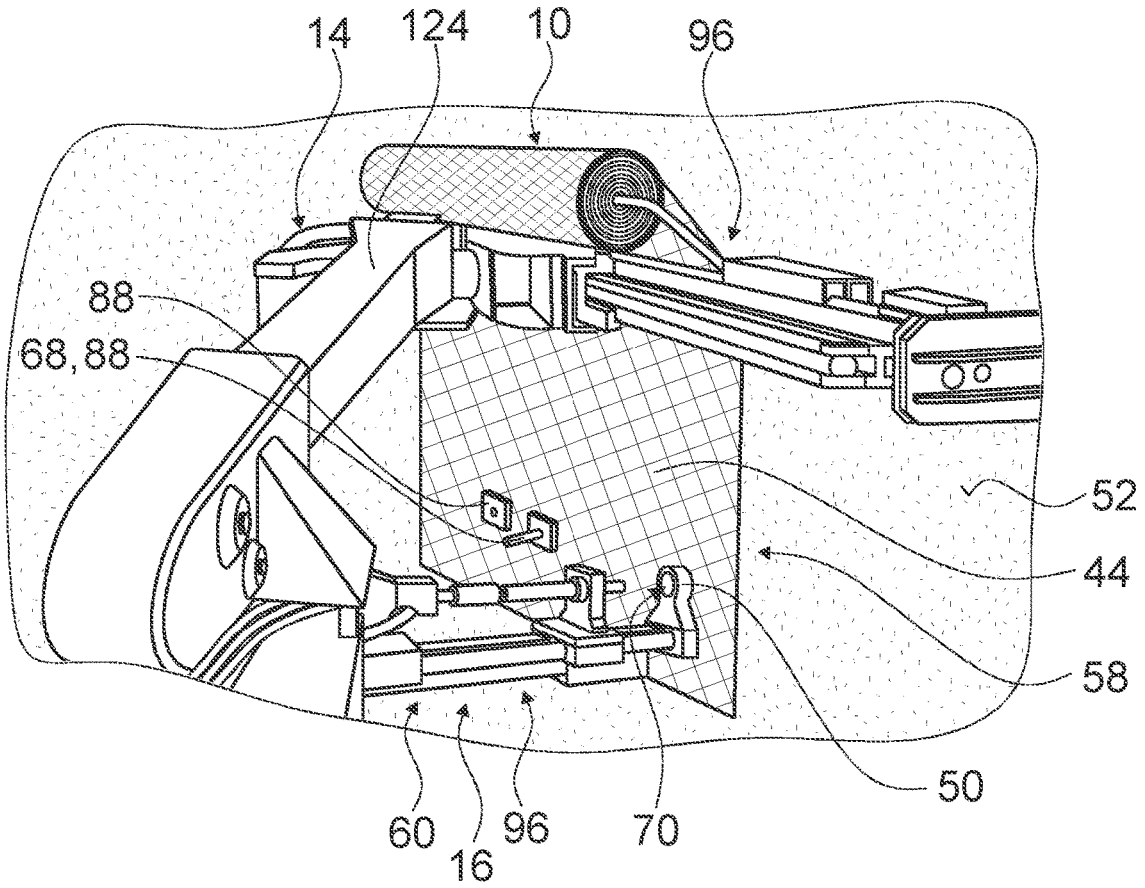
Figure 9:
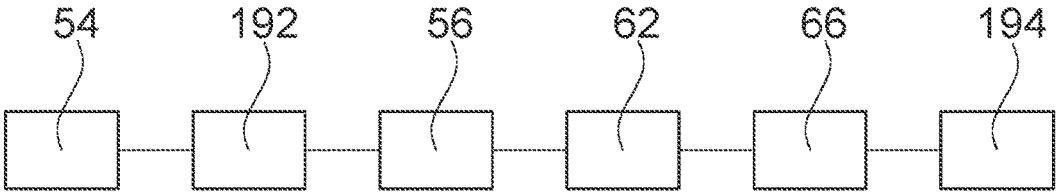

It is shown in:

FIG. 1 a schematic side view of an underground rock drilling machine with two booms, FIG. 2 a schematic perspective view of a roll of protective mesh material, FIG. 3 a schematic perspective view of a mounting device, comprising three bars, FIG. 4 a part of a schematic perspective view of the boom with the mounting device attached to a shank of the boom, FIG. 5 another part of another schematic perspective view of the boom with the mounting device attached to a centralizer of the boom, FIG. 6 another part of another schematic perspective view of the boom with the mounting device attached to the centralizer of the boom, FIG. 7 a process chart of a method for mounting the roll of protective mesh material to the underground rock drilling machine, FIG. 8 the booms of the underground rock drilling machine during an installation procedure of the protective mesh material to a rock surface and FIG. 9 a process chart of a method for attaching the protective mesh material to the rock surface.

DESCRIPTION OF THE EXEMPLARY EMBODIMENT

FIG. 1 shows a schematic drawing of an underground rock drilling machine 12. The underground rock drilling machine 12 is implemented as a drilling jumbo. The drilling jumbo, which is depicted schematically in FIG. 1 belongs to the state of the art. The underground rock drilling machine 12 is at least configured to drill holes into rock surfaces 52 for example in order to apply blasting charges 86 or in order to install rock anchors 88. The underground rock drilling machine 12 comprises a chassis frame 104. The underground rock drilling machine 12 is navigable along a tunnel floor 100. The underground rock drilling machine 12 comprises a control stand 102. The underground rock drilling machine 12 comprises a first boom 14. The underground rock drilling machine 12 comprises a second boom 16. The booms 14, 16 are implemented as drilling booms. Via the control stand 102 operating personnel is able to control the underground rock drilling machine. For example, via the control stand 102, the operating personnel is able to control the spatial positions of the booms 14, 16 and/or the underground rock drilling machine 12, in particular remotely. The booms 14, 16 comprise arms 124. The booms 14, 16, in particular the arms 124, are pivotable about at least a first pivot axis 90. The first pivot axis 90 extends at least substantially vertically. The booms 14, 16, in particular the arms 124, are pivotable about at least a second pivot axis 92. The second pivot axis 92 extends at least substantially perpendicularly to the first pivot axis 90. The expression "substantially vertically" here, in particular, is to define an alignment of a direction relative to a vertical direction, the direction and the vertical direction, in particular when viewed in one plane, enclosing an angle of 90° and the angle comprising a maximum deviation of, in particular, less than 8°, in an advantageous manner less than 5° and in an especially advantageous manner less than 2°. The expression "substantially perpendicularly" here, in particular, is to define an alignment of a direction relative to a reference direction, the direction and the reference direction, in particular when viewed in one plane, enclosing an angle of 90° and the angle comprising a maximum deviation of, in particular, less than 8°, in an advantageous manner less than 5° and in an especially advantageous manner less than 2°.

The booms 14, 16 comprise drilling equipment 96. The drilling equipment 96 comprises a drifter drill 38. The drilling equipment 96 comprises a drill 108. The drill 108 comprises a drill rod 110. The drill 108 comprises a drill bit 112. The drill bit 112 is connected to the drill rod 110. The drill bit 112 is configured to cut into the rock surface 52, when rotated. The drilling equipment 96 comprises a drill drive 114. The drill drive 114 is configured to drive a rotation of the drill 108. The boom 14, 16, in particular the drilling equipment 96, comprises a shank 46. The shank 46 is configured to hold the drill rod 108. The boom 14, 16, in particular the drilling equipment 96, comprises a centralizer 50. The centralizer 50 is configured to centralize the drill 108, in particular the drill rod 110 during a drill operation. The centralizer 50 is arranged close to end of the boom 14, 16, in particular the drilling equipment 96. The drilling equipment 96 comprises a further centralizer 94. The further centralizer 94 is spaced apart from the centralizer 50. The further centralizer 94 is arranged close to the middle of the boom 14, 16, in particular the drilling equipment 96. The boom 14, 16, in particular the drilling equipment 96, comprises a feed 36. The underground rock drilling machine 12 comprises a movement mechanism 32. The movement mechanism 32 is normally used for moving the drill 108. The movement mechanism 32 is configured to at least move the drill 108 along a main extension direction 116 of the boom 14, 16. The feed 36 provides the movement mechanism 32 and/or an actuation unit 48 of the underground rock drilling machine 12. The feed 36 comprises a feed rail 98. The feed 36 comprises a feed drive 106. The feed drive 106 is configured to actuate the drill 108 at least along a direction parallel to the main extension direction 116 of the boom 14, 16. The feed drive 106 is configured to actuate the shank 46 at least along a direction parallel to the main extension direction 116 of the boom 14, 16. The feed drive 106 is powered hydraulically.

The drilling equipment 96 is pivotable relative to the arm 124 of the respective boom 14, 16. The drilling equipment 96 including the feed 36, the centralizer 50 and the shank 46 are pivotable relative to the arm 124 of the respective boom 14, 16. The drilling equipment 96, the feed 36, the centralizer 50 and/or the shank 46 are pivotable about a third pivot axis 118. The third pivot axis 118 is arranged at least substantially perpendicularly with respect to a main extension direction 126 of the feed rail 98 and the extension of which is intersecting the arm 124. The drilling equipment 96, the feed 36, the centralizer 50 and/or the shank 46 are pivotable about a fourth pivot axis 120. The fourth pivot axis 120 is arranged at least substantially parallel with respect to a main extension direction 128 of the arm 124. The drilling equipment 96, the feed 36, the centralizer 50 and/or the shank 46 are pivotable about a fifth pivot axis 122. The fifth pivot axis 122 is arranged at least substantially perpendicularly with respect to a main the third pivot axis 118 and at least substantially perpendicularly with respect to the main extension direction 126 of the feed rail 98.

FIG. 2 shows a schematic drawing of a roll of protective mesh material 10. The roll of protective mesh material 10 comprises protective mesh material 44 in a rolled-up form. The protective mesh material 44 is implemented as a wire netting. Preferably, the wire netting is made from high-tensile steel with a wire thickness of 4.6 mm. Preferably, the wire netting has diamond shaped meshes. Preferably, the wire netting consists of interconnected wires, which are shaped as flat helices. The roll of protective mesh material 10 and the protective mesh material have a width of 2.5 m. When unrolled, the protective mesh material 44 has a length of 15 m. The protective mesh material 44 of the roll of protective mesh material 10 is wound around a center 24 of the roll of protective mesh material 10. The center 24 comprises a hollow pipe 142. The protective mesh material 44 is wound around the hollow pipe 142. The roll of protective mesh material 10 has a first lateral side 22 and a second lateral side 30. The roll of protective mesh material 10 can be unrolled and/or rolled up when rotated about an unrolling axis 34 of the roll of protective mesh material 10. The unrolling axis extends between the lateral sides 22, 30 in the center 24 of the roll of protective mesh material 10. The roll of protective mesh material has a maximal extension 82, which extends between the lateral sides 22, 30 of the roll of protective mesh material 10.

FIG. 3 shows a mounting device. The mounting device is configured to mount a roll of protective mesh material 10 (see for example FIG. 3) to at least one of the booms 14, 16. The mounting device comprises a first bar 20. The first bar 20 comprises a section 72 that is adapted to be inserted into the center 24 of the roll of protective mesh material 10. The first bar 20 comprises a first end 18, which is configured to be inserted into the roll of protective mesh material 10. The first bar 20 comprises a second end 144, which is configured to provide fastening means 146 for fastening the first bar 20 to the boom 14, 16. The first bar 20 is made of metal, in particular (high-tensile) steel or aluminum. The first bar 20 weighs less than 30 kg.

The mounting device comprises a second bar 28. The second bar 28 comprises a section 74 that is adapted to be inserted into the center 24 of the roll of protective mesh material 10. The second bar 28 comprises a first end 26, which is adapted to be inserted into the center 24 of the roll of protective mesh material 10. The second bar 28 comprises a second end 154, which is configured to provide fastening means 146 for fastening the second bar 28 to the boom. The second bar 28 is made of metal, in particular (high-tensile) steel or aluminum. The second bar 28 weighs less than 30 kg. The first bar 20 and the second bar 28 are adapted to bear a weight of at least 100 kg when the bars 20, 28 are used to lift the roll of protective mesh material 10.

The first bar 20 comprises one bend 130 of more than 60°. The first bar 20 comprises one bend 130 of approximately 90°. A radius of curvature 136 of the bend 130 of the first bar 20 is approximately twice a diameter 138 of the first bar 20 in a bending region 140 of the bend 130 of the first bar 20. The first bar 20 has an L-shape. The section 72 of the first bar 20 has a total length of less than 40% of the maximal extension 82 of the roll of protective mesh material 10 parallel to the unrolling axis 34 of the roll of protective mesh material 10. The section 72 of the first bar 20 extends between the bend 130 of the first bar 20 and the first end 18 of the first bar 20. The first bar 20 comprises a fastening unit 80. The fastening unit 80 is adapted to mount the first bar 20 to the shank 46 of the boom 14, 16. The fastening unit 80 is adapted to encompass the shank 46, when mounted to the shank (see also FIG. 3). When mounted to the boom 14, 16, the fastening unit 80 of the first bar 20 is fed over the shank and then secured in this position by a coupler 152. The coupler 152 is implemented as a nut. The coupler 152 is screwed onto the shank. The fastening unit 80 of the first bar 20 in a mounted state is sandwiched between the coupler 152 and the feed drive 106 of the boom 14, 16. The fastening unit 80 of the first bar 20 is arranged at the second end 144 of the first bar 20.

The second bar 28 comprises two bends 132, 134 of more than 60°. The second bar 28 comprises a total bending of more than 90°. The second bar 28 comprises a total bending of about 180°. The second bar comprises two bends 132, 134, each of approximately 90°. Radii of curvature 156, 158 of the bends 132, 134 of the second bar 28 are approximately identical and approximately twice a diameter 148 of the second bar 28 in a bending region 150 of the bend 132 of the second bar 28, which is closer to the first end 26 of the second bar 28. The second bar 28 has a double-L-shape. The section 74 of the second bar 28 has a total length of less than 40% of the maximal extension 82 of the roll of protective mesh material 10 parallel to the unrolling axis 34 of the roll of protective mesh material 10. The section 74 of the second bar 28 extends between the bend 132 of the second bar 28, which is closer to the first end 26 of the second bar 28 and the first end 26 of the second bar 28. In a region around the second end 154 of the second bar 28, the second bar 28 extends parallel to the section 74 of the second bar 28 which is adapted to be inserted into the center 24 of the roll of protective mesh material 10. The second end 154 of the second bar 28 and the section 74 of the second bar 28, which is adapted to be inserted into the center 24 of the roll of protective mesh material 10 point into at least substantially identical directions. The second bar 28 comprises a fastening unit 76. The fastening unit 76 of the second bar 28 is adapted to captively mount the second bar 28 to the boom 14, 16. The fastening unit 76 of the second bar 28 is adapted to mount the second bar 28 to the boom 14, 16 via the centralizer 50 of the boom 14, 16 (cf. FIG. 5). In order to mount the second bar 28 to the boom 14, 16, the second end 154 of the second bar 28 is guided through the centralizer 50 of the boom. When mounted to the boom 14, 16, a mounted position of the second bar 28 is secured by securing means 160 (cf. FIG. 5 or 6). The securing means 160 is implemented as a securing pin, which is adapted to be fed through a feed through element 78 of the second bar 28, which is arranged close to the second end 154 of the second bar 28. The second bar 28 comprises the feed through element 78. The feed trough element 78 is implemented as a hole, which extends centrally and perpendicularly with respect to a main extension direction 176 of the second end 154 of the second bar 28 through the second bar 28.

The mounting device comprises a third bar 84. The third bar 84 has an at least approximately straight shape. The third bar is configured to be inserted into the center 24 of the roll of protective mesh material 10 in between the first end 18 of the first bar 20 and the first end 26 of the second bar 28. The third bar 84 is configured to provide a stabilization of a middle region of the roll of protective mesh material 10, when lifted upwards by the boom 14, 16. The third bar 84 is configured to prevent a sagging of the roll of protective mesh material 10, when lifted upwards by the boom 14, 16. The third bar 84 is made of metal, in particular (high-tensile) steel or aluminum. The third bar 84 weighs less than 30 kg.

FIG. 7 shows a schematic process chart of a method for mounting the roll of protective mesh material 10 to the underground rock drilling machine 12. In at least one method step 162 the first end 18 of the first bar 20 is inserted into the center 24 of the roll of protective mesh material 10 from the first lateral side 22 of the roll of protective mesh material 10 (cf. also FIG. 4). In at least one further method step 164, the first bar 20 is fastened to the boom 14, 16. In the method step 164, the first bar 20 is fastened to the shank 46 of the boom 14, 16 (cf. also FIG. 4). For fastening the first bar 20 to the boom 14, 16, the fastening unit 80 of the first bar is guided over the shank 46 and then secured to the shank 46 by the coupler 152. The fastening unit 80 is configured to secure a position of the first bar 20 and hence of the roll of protective mesh material 10 in a direction parallel to the main extension direction 116 of the boom 14, 16. The fastening unit 80 of the first bar 20 allows a rotation of the first bar 20 about a longitudinal axis 172 of the shank 46 (cf. FIG. 4).

In at least one further method step 180, the third bar 84 is inserted into the center 24 of the roll of protective mesh material 10 from the second lateral side 30 of the roll of protective mesh material 10, which is opposite to the first lateral side 22 of the roll of protective mesh material 10. The third bar 84 is inserted completely into the center 24 of the roll of protective mesh material 10.

In at least one further method step 166, the first end 26 of the second bar 28 is inserted into the center 24 of the roll of protective mesh material 10 from the second lateral side 30 of the roll of protective mesh material 10, which is opposite to the first lateral side 22 of the roll of protective mesh material 10. The first end 26 of the second bar 28 is inserted into the center 24 of the roll of protective mesh material 10 along an insertion direction 174 (cf. FIG. 5). In at least one further method step 168, the second bar 28 is fastened to the boom 14, 16. The second bar 28 is fastened to the boom in a location that is spaced apart from a fastening point of the first bar 20. The two bars 20, 28 are fastened to the boom 14, 16 at opposite ends of the boom 14, 16 along the main extension direction 116 of the boom 14, 16. In the method step 168, the second bar 28 is fastened to the centralizer 50 of the boom 14, 16. For fastening the second bar 28 to the boom 14, 16, the second end 154 of the second bar 28 is fed through a centralizer opening 70 of the centralizer 50. The centralizer 50 comprises the centralizer opening 70. The position of the second bar 28 is then secured by the securing means 160. The fastening unit 76 of the second bar 28 is configured to secure a position of the second bar 28 and hence of the roll of protective mesh material 10 in a direction parallel to the main extension direction 116 of the boom 14, 16. The fastening unit 76 of the second bar 28 allows a rotation of the second bar 28 about a longitudinal axis 178 of the centralizer opening 70 (cf. FIG. 5).

In at least one further method step 188, the boom 14, 16 is lifted and not tilted. In the method step 188, after lifting the boom 14, 16, the roll of protective mesh material 10, which is mounted to the boom 14, 16 by the first bar 20 and by the second bar 28 is suspended on a left side 40 of the boom 14, 16 or on a right side 42 of the boom 14, 16.

In at least one further method step 170, the roll of protective mesh material 10 is secured against autonomous unrolling. In at least one substep 182 of the method step 170, the roll of protective mesh material 10 is tensioned by applying a pressure to at least one of the lateral sides 22, 30 of the roll of protective mesh material 10 in order to secure the roll of protective mesh material 10 against autonomous unrolling. In the substep 182, the roll of protective mesh material 10 is secured against autonomous unrolling by an application of the movement mechanism 32 of the underground rock drilling machine 12. In the substep 182, the movement mechanism 32 is actuated in a direction that is parallel to the unrolling axis 34 of the roll of protective mesh material 10, in order to tension the roll of protective mesh material 10, yielding the securing against autonomous unrolling. In the substep 182, the roll of protective mesh material 10 is then secured by applying a hydraulic feed pressure of the feed 36 of the drifter drill 38 of the underground rock drilling machine 12, which leads to the tensioning the roll of protective mesh material 10. Therefore, the movement mechanism 32, in particular the feed 36 of the drifter drill 38, is used for moving and/or for pressing the first bar 20 and the second bar 28 towards each other. Consequently, the roll of protective mesh material 10 is slightly jammed between the first bar 20 and the second bar 28.

In at least one further substep 184 of the method step 170, the roll of protective mesh material 10, which is mounted to the boom 14, 16 is tilted in such a way that the protective mesh material 44 of the roll of protective mesh material 10 rests on the left side 40 of the boom in order to secure the roll of protective mesh material 10 against autonomous unrolling. Alternatively, in at least one further substep 186 of the method step 170, the roll of protective mesh material 10, which is mounted to the boom 14, 16 is tilted in such a way that the protective mesh material 44 of the roll of protective mesh material 10 rests on the right side 42 of the boom 14, 16 (cf. also FIG. 8) in order to secure the roll of protective mesh material 10 against autonomous unrolling. In at least one further method step 190, the roll of protective mesh material 10 is brought into an installation position by actuating the boom 14, 16 the roll of protective mesh material 10 is attached to.

FIG. 9 shows a schematic process chart of a method for attaching the protective mesh material 10 to the rock surface 52, in which method the protective mesh material 10 is mounted to a first boom 14 of the underground rock drilling machine 12 according to a method comprising at least part of the method steps 162, 164, 166, 168, 170, 180, 188, 190 shown in FIG. 7. In at least one method step 54, the first boom 14 with the rolled-up protective mesh material 44 attached, is moved towards the rock surface 52. In the method step 54, the first boom 14 is aligned with the rock surface 52. In at least one further method step 192, a freely suspended end 58 of the roll of protective mesh material is guided around the roll of protective mesh material 10 and over the tilted first boom 14 (cf. FIG. 8). In at least one further method step 56 the freely suspended end 58 of the protective mesh material 10 is pinned to the rock surface 52 by a pinning device 60 of the second boom 16 of the underground rock drilling machine 12. The drilling equipment 96, in particular the drifter drill 38, is provided as the pinning device 60. In at least another further method step 62, the protective mesh material 44 is unrolled by moving the first boom 14 along the rock surface 52 in an unrolling direction 64, which is arranged perpendicularly to the unrolling axis 34 of the roll of protective mesh material 10, in particular the rolled-up protective mesh material 44. In at least one additional further method step 66, the pinning device 60 attaches the unrolled protective mesh material 44 to the rock surface 52 at specific distances along the unrolling direction 64. Typically, around ten pins, in particular ten rock anchors 88, are used for a 15 m sheet of protective mesh material 44. In at least one further method step 194, the protective mesh material 44 is additionally anchored to the rock surface 52 by cohesively joining anchors 68 using the pinning device 60 of the second boom 16. The cohesively joining anchors 68 are implemented as resin bolts. For the installation of a resin bolt, first a hole 198 is drilled using the second boom 16, then resin packages 196 are inserted into the hole 198 and then a metal rock anchor 88 is inserted into the hole 198 filled with resin packages 196, which subsequently are ripped open and cause a cohesive bond between the rock anchor 88 and surrounding rock 200 (cf. also FIG. 1).

REFERENCE NUMERALS

10 Roll of protective mesh material
12 Underground rock drilling machine
14 Boom
16 Boom
18 First end
20 First bar
22 First lateral side
24 Center
26 First end
28 Second bar
30 Second lateral side
32 Movement mechanism
34 Unrolling axis
36 Feed
38 Drifter drill
40 Left side
42 Right side
44 Protective mesh material
46 Shank
48 Actuation unit
50 Centralizer
52 Rock surface
54 Method step
56 Method step
58 End
60 Pinning device
62 Method step
64 Unrolling direction
66 Method step
68 Cohesively joining anchor
70 Centralizer opening
72 Section
74 Section
76 Fastening unit
78 Feed through element
80 Fastening Unit
82 Maximal Extension
84 Third bar
86 Blasting charge
88 Rock anchor
90 First pivot axis
92 Second pivot axis
94 Further centralizer
96 Drilling equipment
98 Feed Rail
100 Tunnel floor
102 Control stand
104 Chassis frame
106 Feed drive
108 Drill
110 Drill rod
112 Drill bit
114 Drill drive
116 Main extension direction
118 Third pivot axis
120 Fourth pivot axis
122 Fifth Pivot axis
124 Arm
126 Main extension direction
128 Main extension direction
130 Bend
132 Bend
134 Bend
136 Radius of curvature
138 Diameter
140 Bending region
142 Hollow pipe
144 Second end
146 Fastening means
148 Diameter
150 Bending region
152 Coupler
154 Second end
156 Radius of curvature
158 Radius of curvature

160 Securing means
162 Method step
164 Method step
166 Method step
168 Method step
170 Method step
172 Longitudinal axis
174 Insertion direction
176 Main extension direction
178 Longitudinal axis
180 Method step
182 Substep
184 Substep
186 Substep
188 Method step
190 Method step
192 Method step
194 Method step
196 Resin package
198 Hole
200 Rock

The invention claimed is:

1. A method for mounting a roll of protective mesh material to an underground rock drilling machine comprising at least one drilling boom, the method including at least the following steps:

inserting a first end of a first bar from a first lateral side of the roll of protective mesh material into a center of the roll of protective mesh material;

fastening the first bar directly or indirectly to the drilling boom;

inserting a first end of a second bar from a second lateral side of the roll of protective mesh material opposite the first lateral side into the center of the roll of protective mesh material;

fastening the second bar directly or indirectly to the drilling boom in a location that is spaced apart from the first bar; and securing the roll of protective mesh material against autonomous unrolling, wherein for securing the roll of protective mesh material against autonomous unrolling, the roll of protective mesh material is tensioned by applying a pressure to at least one of the lateral sides of the roll of protective mesh material or wherein in order to secure the roll of protective mesh material against autonomous unrolling, the roll of protective mesh material mounted to the drilling boom is tilted in such a way that the protective mesh material of the roll of protective mesh material rests on a left side of the drilling boom or on a right side of the drilling boom, wherein the roll of protective mesh material is secured against autonomous unrolling by a movement mechanism of the underground rock drilling machine, which is normally applied for moving a drill, and wherein the movement mechanism is used for moving and/or pressing the first bar and the second bar towards each other.

2. The method according to claim 1, wherein, in order to secure the roll of protective mesh material by tensioning the roll of protective mesh material, the movement mechanism is actuated in a direction that is at least substantially parallel to an unrolling axis of the roll of protective mesh material.

3. The method according to claim 1, wherein the roll of protective mesh material is secured by applying a feed pressure of a feed of a drifter drill of the underground rock drilling machine to tension the roll of protective mesh material.

4. The method according to claim 1, wherein, when the drilling boom is lifted and not tilted, the roll of protective mesh material which is mounted to the drilling boom by the first bar and by the second bar is suspended on the left side of the drilling boom or on the right side of the drilling boom.

5. The method according to claim 1, wherein in order to secure the roll of protective mesh material against autonomous unrolling, the roll of protective mesh material mounted to the drilling boom is tilted in such a way that the protective mesh material of the roll of protective mesh material rests on a left side of the drilling boom or on a right side of the drilling boom.

6. A method for attaching protective mesh material to a rock surface, in which the protective mesh material is mounted to a first drilling boom of an underground rock drilling machine according to the mounting method of claim 1, wherein in a method step, the first drilling boom with the rolled-up protective mesh material is moved towards the rock surface and is at least substantially aligned with the rock surface, wherein in a further method step a freely suspended end of the protective mesh material is pinned to the rock surface by a pinning device of a second boom of the underground rock drilling machine, wherein in another further method step the protective mesh material is unrolled by moving the first drilling boom along the rock surface in an unrolling direction at least substantially perpendicularly to an unrolling axis of the rolled-up protective mesh material, and wherein in an additional further method step, the pinning device attaches the unrolled protective mesh material to the rock surface at specific distances along the unrolling direction.

7. The method according to claim 6, wherein the protective mesh material is additionally anchored to the rock surface by cohesively joining anchors using the pinning device of the second boom.

8. A mounting device, which is configured to mount a roll of protective mesh material to a drilling boom of an underground rock drilling machine according to the method of claim 1, with at least a first bar and a second bar, wherein each bar comprises a section that is adapted to be inserted into a center of the roll of protective mesh material and to bear a weight of at least 100 kg when the bars are used to lift the roll of protective mesh material.

9. The mounting device according to claim 8, wherein at least one of the bars comprises at least one bend of at least 60°.

10. The mounting device according to claim 9, wherein at least the second bar comprises a fastening unit, which is adapted to captively mount the second bar to the drilling boom via a centralizer of the drilling boom.

11. The mounting device according to claim 8, wherein at least the second bar comprises a total bending of more than 90°.

12. The mounting device according to claim 11, wherein at least the second bar comprises a second end that extends at least substantially parallel to the section of the second bar which is adapted to be inserted into a center of the roll of protective mesh material.

13. The mounting device according to claim 12, wherein the second end of at least the second bar and the section of the second bar which is adapted to be inserted into a center of the roll of protective mesh material point into at least substantially identical directions.

14. The mounting device according to claim 8, wherein at least the first bar has an L-shape.

15. The mounting device according to claim 8, wherein at least the first bar comprises a fastening unit, which is adapted to mount the first bar to a shank of the drilling boom by at least partially encompassing the shank.

16. The mounting device according to claim 8, wherein the sections of the bars which are configured to be inserted into the center of the roll of protective mesh material have a total length of less than 40% of a maximal extension of the roll of protective mesh material, parallel to an unrolling axis of the roll of protective mesh material.

17. The mounting device according to claim 8, further comprising a third bar, which has an at least approximately straight shape and which is configured to be inserted into the center of the roll of protective mesh material in between the at least two bars.

18. A mounting device, which is configured to mount a roll of protective mesh material to a drilling boom of an underground rock drilling machine according to a method including at least the following steps:

inserting a first end of a first bar from a first lateral side of the roll of protective mesh material into a center of the roll of protective mesh material;

fastening the first bar directly or indirectly to the drilling boom;

inserting a first end of a second bar from a second lateral side of the roll of protective mesh material opposite the first lateral side into the center of the roll of protective mesh material;

fastening the second bar directly or indirectly to the drilling boom in a location that is spaced apart from the first bar; and securing the roll of protective mesh material against autonomous unrolling, wherein for securing the roll of protective mesh material against autonomous unrolling, the roll of protective mesh material is tensioned by applying a pressure to at least one of the lateral sides of the roll of protective mesh material or wherein in order to secure the roll of protective mesh material against autonomous unrolling, the roll of protective mesh material mounted to the drilling boom is tilted in such a way that the protective mesh material of the roll of protective mesh material rests on a left side of the drilling boom or on a right side of the drilling boom;

wherein the mounting device has at least a first bar and a second bar, wherein each bar comprises a section that is adapted to be inserted into a center of the roll of protective mesh material and to bear a weight of at least 100 kg when the bars are used to lift the roll of protective mesh material, and wherein at least the first bar comprises a fastening unit, which is adapted to mount the first bar to a shank of the drilling boom by at least partially encompassing the shank.

* * * * *